United States Patent [19]

Kommrusch

[11] 4,135,193

[45] Jan. 16, 1979

[54] DIRECTIONAL DUPLEXER

[75] Inventor: Richard S. Kommrusch, Schaumburg, Ill.

[73] Assignee: Motorola, Inc., Schaumburg, Ill.

[21] Appl. No.: 820,667

[22] Filed: Aug. 1, 1977

[51] Int. Cl.[2] ..... H01Q 3/26

[52] U.S. Cl. ..... 343/854; 343/911 L; 343/909

[58] Field of Search ..... 343/854, 754, 100 SA, 343/911 R, 911 L, 910, 909, 722, 756

[56] References Cited

U.S. PATENT DOCUMENTS

| | | | |
|---|---|---|---|
| 2,848,714 | 8/1958 | Ring | 343/854 |
| 3,276,019 | 9/1966 | Fackler | 343/854 |
| 3,324,475 | 6/1967 | Milne | 343/854 |
| 3,438,038 | 4/1969 | Marston | 343/854 |

*Primary Examiner*—Alfred E. Smith
*Assistant Examiner*—David K. Moore
*Attorney, Agent, or Firm*—James P. Hamley; James W. Gillman

[57] ABSTRACT

There is disclosed an electronic steering circuit suitable to be utilized in scanning antenna array systems for automatically steering receive and transmit signals between particular antenna elements and a plurality of transceivers. In the preferred form, the electronic steering circuit is coupled between each one of a plurality of antenna elements and a lens, such as a Luneberg lens. Each steering circuit is adapted to be connected to a particular transceiver. Transmitted signals from the transceiver are routed through the steering circuit to the lens and cumulated receive signals from the lens are routed through the steering circuit to the transceiver.

11 Claims, 3 Drawing Figures

DIRECTIONAL DUPLEXER

BACKGROUND OF THE INVENTION

This invention relates to electronic steering circuits and more particularly to a directional duplexer suitable for use in omnidirectional scanning antenna systems.

Contemporary scanning antenna systems generally employ a plurality of antenna elements in a circular array to permit 360° coverage. In practice these systems employ mechanical switching systems to enable the simplex transmission or reception of electromagnetic energy over 360° of Azimuth. These mechanical switching systems usually comprise mechanical relays and are not entirely satisfactory. For instance, the lifetime of mechanical relays is relatively short such that the relays must be replaced quite often. Furthermore, the mechanical switching systems are rather complex in nature. The complexity of such systems not only increases the insertion loss of such antenna array systems thereby decreasing antenna gain but also affects the scan rate which is necessarily relatively slow as compared to that of an electronic switching system.

Therefore a need exists for an improved electronic switching system for providing automatic switching of simplex transmission and reception signals or a directional duplexer for providing simultaneous steering of duplex transmission and reception signals.

SUMMARY OF THE INVENTION

An object of the present invention is to provide a directional duplexer circuit which is suitable for use in scanning antenna array systems to provide simultaneous steering of duplex transmission and reception signals.

In accordance with this foregoing object there is provided a directional duplexer circuit for use in antenna scanning arrays. The directional duplexer of the present invention is comprised of a duplexer filter and signal steering circuit means for steering the respective signals to and from the filter. The filter is connected to a transceiver or radio such that transmitted signals therefrom are steered through the filter and through the signal steering circuit means to appropriate antenna elements of the antenna array. Similarly, receive signals are steered through the signal steering means through the filter to appropriate transceivers.

DETAILED DESCRIPTION OF THE PREFERRED EMBODIMENTS

Referring to the Figures, there are shown several embodiments of the directional duplexer of the present invention. The directional duplexers of the invention are suitable to be utilized in an omnidirectional scanning antenna array system to provide simultaneous transmitting and receiving functions. A feature of such an antenna array is that all antennas might be used simultaneously to "look" in a particular direction. As is understood, the antenna array may include a plurality of N antenna elements arranged in a circular array. Each nth antenna element is coupled to a respective nth port of a cumulator means or lens which, as is known in the art, operatively connects the particular antenna element to a respective transceiver or radio in order that simultaneous transmission of signals and reception thereof are provided.

The present invention describes means operable in the receive mode to pass the signal from a particular set of antenna elements through the lens to a respective radio (transceiver). In the transmit mode the transmit signal from a respective radio is passed to the lens and therethrough to the predetermined antenna elements as is understood. The lens or cumulator means may be a Luneberg or R-KR lens for example.

Figure 1:
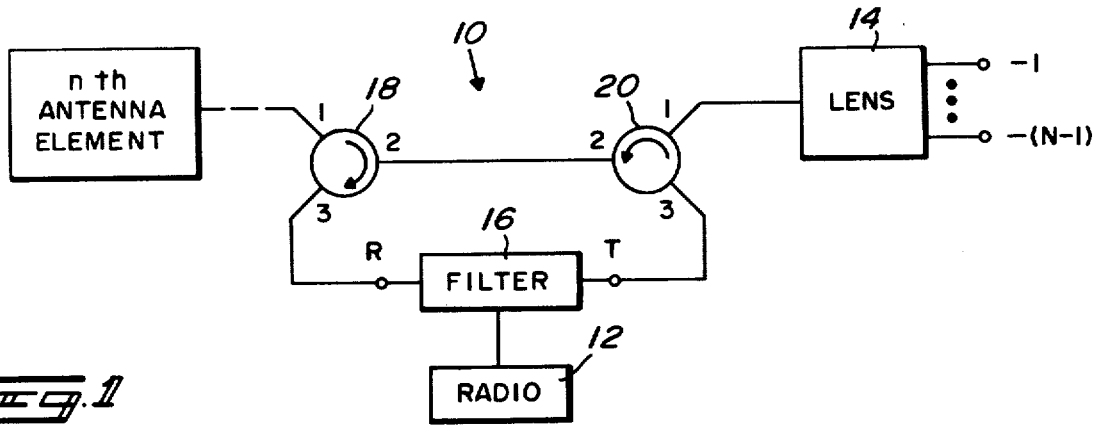
FIG. 1 illustrates in partial schematic diagram form a directional duplexer of one embodiment of the present invention.

Turning now to FIG. 1, there is illustrated directional duplexer 10 of one embodiment of the invention. In a transmit mode signals are transmitted from radio 12 and are routed to lens 14 and transmitted therefrom to all other antenna elements coupled to the lens at respective ports thereof as is understood.

In operation, each port (1 through N) of the lens is coupled to a particular nth antenna element through a respective directional duplexer 10. Thus, with N antenna elements, lens 14 would have N ports, each coupled to a nth antenna element through a particular duplexer 10. Moreover, a transmit signal passed through lens 14 to duplexer 10 is routed to the particular nth antenna element. Similarly, in the receive mode, a signal received at a nth antenna element is passed directly through duplexer 10 to lens 14; a receive signal from lens 14 which is applied to a particular duplexer 10 is routed to radio 12 thereof.

Directional duplexer 10 is illustrated as including filter 16 having first, second and third ports, the third port is coupled to radio or transceiver 12. Filter 16 may be any type of duplexer filter generally known in the art such as a duplexer which separates two frequency bands. Duplexer 10 further includes a signal steering circuit comprising circulators 18 and 20 each having three ports numbered 1, 2 and 3 respectively. As is known, the principle property of a circulator is that energy entering one port exits the next port, i.e., energy entering at port 1 exits at port 2, energy entering at port 2 exits at port 3 and energy entering port 3 exits at port 1.

Duplexer filter 16 has the following properties. In the receive mode, the first or R port of the filter has a matched impedance to the system, i.e., 50 ohms, whereas the T port has a high impedance or VSWR. In the transmit mode, the T port is essentially made to be 50 ohms or matched to the system and the R port has a high VSWR.

Operation in the transmit mode may be understood as follows. The transmitted signal from radio 12 enters filter 16 and exits port T and then enters port 3 of circulator 20. The transmitted signal then exits at port 1 of circulator 20 and is passed through lens 14 to the appropriate antenna elements which, although not particularly shown, are coupled to the lens as described previously. Likewise, transmitted signals which are cumulated through lens 14 to appear at a first external port of duplexer 10 enter circulator 20 at port 1 and exit at port 2. This signal is then routed to port 2 of circulator 18 and exits at port 3. Because the R port of filter 16 has a high VSWR, substantially all of the energy of the transmitted signal is reflected therefrom and enters port 3 to exit at port 1 of circulator 18. This signal is then routed through the external port connection of circulator 18 to the particular nth antenna element. Thus, in summary, the transmitted signal from radio 12 is caused to be routed through lens 14 whereas any transmitted signals that are cumulated and routed through lens 14 is passed directly to the nth antenna element.

In the receive mode, any signal received at the nth antenna element is passed through the lens to be received at a particular radio 12. Thus, the receive signal from the antenna element enters port 1 of circulator 18 and exits at port 2 thereof. The energy then enters port 2 of circulator 20 and exits at port 3 thereof. Because the T port of filter 16 has a high VSWR, in the receive mode, the signal is then reflected therefrom to enter port 3 of circulator 20. The receive signal then exits at port 1 and is passed through lens 14. The receive signals that are cumulated through lens 14 to be supplied at port 1 of circulator 20 are routed to radio 12 in the following manner. The receive signal from lens 14 exits port 2 of circulator 20 and enters port 2 of circulator 18 and then exits at port 3. This receive signal is then passed through filter 16 to radio 12. Thus, what has been described is a unique signal steering system for simultaneously and automatically routing both receive and transmit signals to and from the antenna array system for duplex operation and for simplex operation without the use of mechanical switches and their associated disadvantages.

Figure 2:
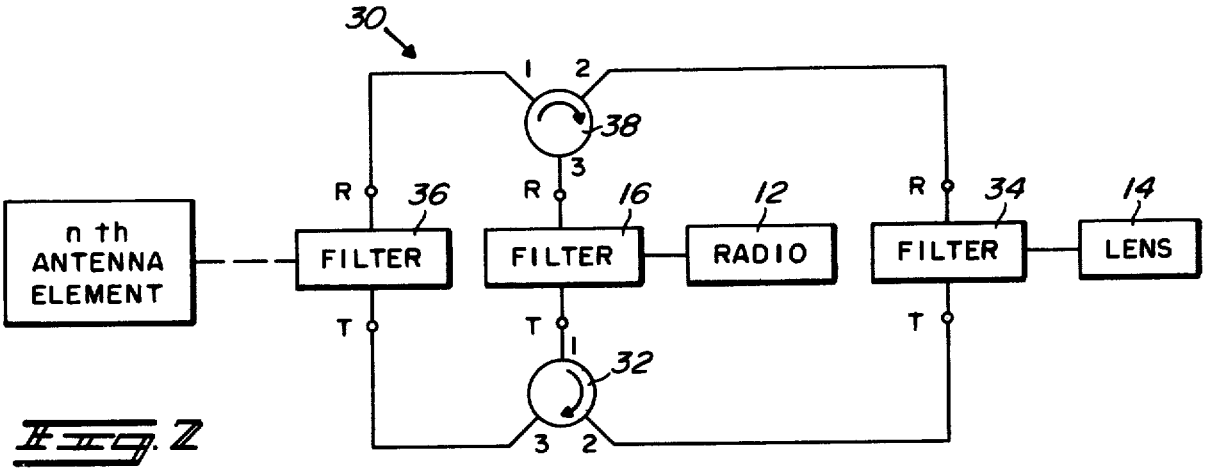
FIG. 2 illustrates a directional duplexer of a second embodiment of the invention.
Figure 3:
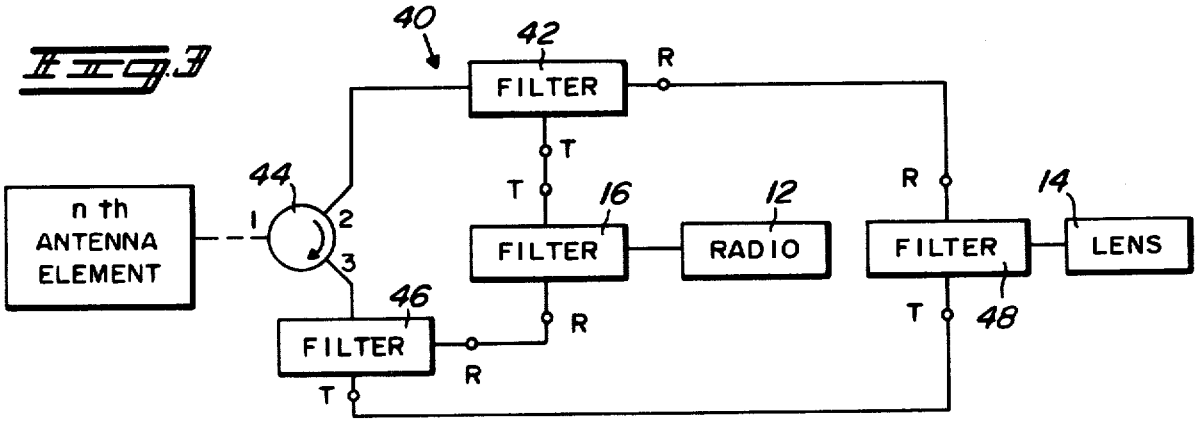
FIG. 3 illustrates a directional duplexer of a third embodiment of the present invention.

Turning to FIGS. 2 and 3 there are illustrated other embodiments of the invention wherein the same reference numerals of FIG. 1 are used to identify corresponding and similar components. It is to be understood that the operating characteristics of all filters shown are identical to that of filter 16.

Operation of directional duplexer 30 in FIG. 2 is as follows. In the transmit mode, the transmitted signal from radio 12 is routed through filter 16, circulator 32 to filter 34 and therethrough to lens 14. Transmitted signals cumulated by lens 14 and which appear at filter 34 are routed therethrough to circulator 32, through filter 36 and to the nth antenna element.

In the receive mode, a signal received at the nth antenna element is routed through filter 36 to circulator 38 and therethrough to filter 34. This receive signal is then passed through filter 34 through lens 14 to appropriate radios. Receive signals cumulated by lens 14 and applied to filter 34 are routed through circulator 38 to the R port of filter 16 and therethrough to radio 12.

Operation of directional duplexer 40 of FIG. 3 is quite similar to the above and is as follows. The transmitted signal from radio 12 is routed through filter 16, filter 42, circulator 44, through filter 46 and filter 48 through lens 14 to the appropriate antenna elements. Cumulated transmitted signals appearing at filter 48 from lens 14 are routed therethrough to filter 46, to circulator 44 and exit therefrom at port 1 to the nth antenna element.

In the receive mode, received signals from the nth antenna element are passed through circulator 44 exiting at port 2. The receive signal is then routed through filter 42 to filter 48 and therethrough to lens 14. Cumulated receive signals from lens 14 are passed through filter 48 and 42 to circulator 44. From circulator 44 these cumulated receive signals exit at port 3 and pass through filter 46 to filter 16 and therethrough to radio 12.

What has been described are several unique directional duplexers which are suitable to be utilized in antenna array systems to provide simultaneous transmitting and receiving of radio frequency signals. A significant advantage provided by the disclosed duplexers of the embodiments of the present invention is that simultaneous steering is provided for duplex operation and switching is accomplished without the requirement of mechanical switches such as relays which have short lifetimes and insertion losses associated therewith. An inherent advantage of an antenna array using the duplexers of the present invention is the increased system gain created thereby. Because each duplexer has an associated radio coupled thereto the resultant gain bandwidth of the radiation pattern is enhanced.

What is claimed is:

1. A directional duplexer circuit having first, second and third ports for providing simultaneous steering of applied signals between predetermined ones of the ports in a duplex mode of operation, comprising:

filter means having first, second and third ports which is responsive to a signal being applied at said first port for causing said signal to be supplied at said third port thereof annd said filter means being responsive to a transmit signal being applied at said third port for causing the same to be supplied at said second port thereof, said third port of said filter means being coupled to the third port of the directional duplexer circuit; and signal steering means having an output port, an input port, first and second ports, said output port being coupled to said first port of said filter means, said input port being coupled to said second port of said filter means, said first port of said signal steering means being coupled to the first port of the directional duplexer circuit, said second port of said signal steering means being coupled to the second port of the directional duplexer circuit, said signal steering means being response to a first receive signal being applied at the first port of the directional duplexer circuit for steering said first receive signal to said second port thereof, said signal steering means being responsive to a second receive signal being applied at the second port of the directional duplexer circuit for steering said second receive signal to said output port of said signal steering means, said signal steering means being responsive to said transmit signal being applied to said input port thereof from said second port of said filter means for steering said transmit signal to the second port of the directional duplexer circuit, said signal steering means being responsive to another transmit signal being applied to the second port of the directional duplexer circuit for steering the same to the first port of the directional duplexer circuit.

2. The directional duplexer circuit of claim 1, wherein said signal steering means includes:

first circulator means having first, second and third ports, said first port being coupled to said second port of said signal steering means, said third port being coupled to said input port of said signal steering means; and second circulator means having first, second and third ports, said first port of said second circulator means being coupled to said first port of said signal steering means, said third port of said second circulator means being coupled to said output port of said signal steering means, and said second port of said second circulator means being coupled to said second port of said first circulator means.

3. An omnidirectional scanning antenna system utilizing the directional duplexer of claim 2, including:

N-antenna elements, each one of said N-antenna elements being coupled to the first port of a respective directional duplexer circuit; and cumulator means having N ports, each Nth port thereof being coupled to the second port of a respective directional duplexer circuit.

4. The directional duplexer of claim 1 wherein said signal steering means includes:

second filter means having first, second and third ports, said third port thereof being coupled to said second port of said signal steering means;

third filter means having first, second and third ports, said third port of said third filter means being coupled to said first port of said signal steering means;

first circulator means having first, second and third ports, said first port of said first circulator means being coupled to said first port of said third filter means, said second port of said first circulator means being coupled to said first port of said second filter means, said third port of said first circulator means being coupled to said output port of said signal steering means of the directional duplexer circuit; and second circulator means having first, second and third ports, said first port of said second circulator means being coupled to said input port of said signal steering means of the directional duplexer circuit, said second port of said second circulator means being coupled to said second port of said second filter means, said third port of said second circulator means being coupled to said second port of said third filter means.

5. An omnidirectional scanning antenna system utilizing the directional duplexer of claim 4 including:

N-antenna elements, each one of said N-antenna elements being coupled to the first port of a respective directional duplexer circuit; and cumulator means having N ports each one of said N ports of said cumulator means being coupled to the second port of a respective directional duplexer circuit.

6. The directional duplexer of claim 1 wherein said signal steering means includes:

circulator means having first, second and third ports, said first port of said circulator means being coupled to said first port of said signal steering means;

second filter means having first, second and third ports, said third port of said second filter means being coupled to said second port of said signal steering means;

third filter means having first, second and third ports, said first port of said third filter means being coupled to said first port of said second filter means, said third port of said third filter means being coupled to said second port of said circulator means, said second port of said third filter means being coupled to said input port of said signal steering means of the directional duplexer circuit; and fourth filter means having first, second and third ports, said first port of said fourth filter means being coupled to said output port of said signal steering means of the directional duplexer circuit, said third port of said fourth filter means being coupled to said third port of said circulator means, and said second port of said fourth filter means being coupled to said second port of said second filter means.

7. An omnidirectional scanning antenna system utilizing the directional duplexer of claim 6 including:

N-antenna elements, each one of said N-antenna elements being coupled to the first port of a respective port of a directional duplexer circuit; and cumulator means having N ports each one of said N ports of said cumulator means being coupled to the second port of a directional duplexer circuit.

8. In an omnidirectional scanning array including a cumulator means having N ports for receiving and transmitting radio signals respectively, N-antenna elements each coupled to a respective one of said N ports of said cumulator means, the improvement including switching means coupled between each N antenna element and N port of the cumulator means and comprising N directional duplexers, each duplexer comprising:

filter means having first, secnd and third ports, said third port thereof being coupled to a transceiver means, said filter means being responsive to a transmit signal applied thereto from said transceiver means for steering the same to said second port thereof, said filter means being responsive to a receive signal applied at said first port thereof for supplying the same to said transceiver means; and signal steering means having an output and an input port coupled respectively to said first and second ports of said filter means, first and second external ports, said first external port thereof being coupled to a respective one of the N ports of the antenna element, said second external port being coupled to a respective one of the N ports of the cumulator means, said signal steering means being responsive to a receive signal being applied from the cumulator means at said second external port for steering the same to said first port of said filter means, said signal steering means being responsive to a receive signal being applied from a respective N antenna element at said first external port for steering the same to said cumulator means, said signal steering means being responsive to a transmit signal being applied thereto at said input port from said filter means for steering the same to said cumulator means, and said signal steering means being responsive to a transmit signal being applied thereto from said cumulator means at said second external port for steering the same to said respective N antenna element.

9. The antenna array of claim 8 wherein said signal steering means includes:

first circulator means having first, second and third ports, said first port being coupled to said second external port of said signal steering means, said third port being coupled to said first port of said filter means; and second circulator means having first, second and third ports, said first port being coupled to said second external port of said signal steering means, said third port being coupled to said second port of said filter means, and said second port being coupled to said second port of said first circulator means.

10. The antenna array of claim 8 wherein said signal steering means includes:

second filter means having first, second and third ports, said third port being coupled to said second external port of said signal steering means;

third filter means having first, second and third ports, said third port being coupled to said first external port of said signal steering means;

first circulator means having first, second and third ports, said first port being coupled to said first port of said third filter means, said second port being coupled to said first port of said second filter means, said third port being coupled to said first port of said filter means of the directional duplexer; and second circulator means having first, second and third ports, said first port of said second circulator means being coupled to said second port of said filter means of the directional duplexer, said second port of said second circulator means being coupled to said second port of said second filter means, and said third port being coupled to said second port of said third filter means.

11. The antenna array of claim 8 wherein said signal steering means includes:

circulator means having first, second and third ports, said first port being coupled to said first external port of said signal steering means;

second filter means having first, second and third ports, said third port of said second filter means being coupled to said second external port of said signal steering means;

third filter means having first, second and third ports, said first port of said third filter means being coupled to said first port of said second filter means, said third port of said third filter means being coupled to said second port of said circulator means, said second port of said third filter means being coupled to said second port of said filter means of the directional duplexer; and fourth filter means having first, second and third ports, said first port of said fourth filter means being coupled to said first port of said filter means of the directional duplexer, said third port of said fourth filter means being coupled to said third port of said circulator means, and said second port of said fourth filter means being coupled to said second port of said second filter.

* * * * *